US008267607B2

(12) United States Patent
Harris

(10) Patent No.: US 8,267,607 B2
(45) Date of Patent: Sep. 18, 2012

(54) SURFACE WORKING APPARATUS

(75) Inventor: Robert D. Harris, Logan, UT (US)

(73) Assignee: Harris Research, Inc., Logan, UT (US)

( * ) Notice: Subject to any disclaimer, the term of this patent is extended or adjusted under 35 U.S.C. 154(b) by 1702 days.

(21) Appl. No.: 11/000,121

(22) Filed: Nov. 29, 2004

(65) Prior Publication Data

US 2005/0095053 A1 May 5, 2005

(51) Int. Cl.
*A47L 13/26* (2006.01)

(52) U.S. Cl. ..... 401/139; 401/140

(58) Field of Classification Search ..... 401/136–140, 401/261–266; 15/210.1, 220.1
See application file for complete search history.

(56) References Cited

U.S. PATENT DOCUMENTS 2,291,435 A * 7/1942 Anderson et al. ..... 15/220.1
2,682,071 A * 6/1954 Torvald ..... 15/147.2
2,842,791 A 7/1958 Statler
3,038,188 A 6/1962 Rebemak
3,040,353 A 6/1962 Gray
3,199,136 A 8/1965 George
3,254,804 A * 6/1966 Grant ..... 222/174
3,380,099 A * 4/1968 Hunt et al. ..... 15/210.1
3,732,652 A 5/1973 Furgal
3,753,267 A * 8/1973 Johnson, Sr. ..... 15/210.1
3,761,991 A 10/1973 Moss
3,778,860 A 12/1973 Thielen
3,871,378 A 3/1975 Duncan
3,888,248 A 6/1975 Moore
3,945,386 A 3/1976 Anczurowski
3,945,736 A 3/1976 Rittenbaum
3,967,623 A 7/1976 Butterworth
3,991,431 A 11/1976 Thielen
4,050,111 A 9/1977 Mallory
4,300,920 A 11/1981 Grove
RE30,972 E 6/1982 Kyle
4,603,069 A 7/1986 Haq
4,614,679 A 9/1986 Farrington
4,733,774 A 3/1988 Ping
4,745,021 A 5/1988 Ping
4,769,267 A 9/1988 Hoyt
4,784,892 A 11/1988 Storey
4,797,310 A 1/1989 Barby
4,852,210 A 8/1989 Krajicek
4,863,299 A 9/1989 Osberghaus
4,902,544 A 2/1990 Kim
4,961,242 A 10/1990 Kresse
4,995,133 A 2/1991 Newell
5,071,489 A 12/1991 Silvenis
5,080,517 A 1/1992 Lynn
5,090,832 A 2/1992 Rivera
5,093,190 A 3/1992 Kwok
5,094,559 A 3/1992 Rivera
5,104,728 A 4/1992 Obermeyer
5,115,535 A 5/1992 Casademunt Ferre
(Continued)

*Primary Examiner* — Huyen Le
(74) *Attorney, Agent, or Firm* — Kunzler Law Group, PC

(57) ABSTRACT

A surface working apparatus or cleaning implement that is useful in removing soils and other undesirable items from carpeting, hard flooring or any surface. More particularly, the present invention relates to a floor cleaning apparatus having a handle and an absorbent cleaning pad which is removably attached to a cleaning head and disposable after use. An aerosol canister is connected to the apparatus and a trigger is used to selectively dispense the contents of the canister in front of the cleaning head for cleaning the flooring. Various locking means are added to the floor cleaning tool to ensure proper floor chemical application.

20 Claims, 7 Drawing Sheets

U.S. PATENT DOCUMENTS 5,135,521 A 8/1992 Luceri
5,139,841 A 8/1992 Makoui
5,177,831 A 1/1993 Wirth
5,187,830 A 2/1993 Giallourakis
5,195,999 A 3/1993 Harada
5,217,787 A 6/1993 Monahan
5,281,208 A 1/1994 Thompson
5,300,345 A 4/1994 Aihara
5,333,347 A * 8/1994 Stranders ..... 15/220.1
5,419,015 A 5/1995 Garcia
5,454,659 A 10/1995 Vosbikian
H1511 H 12/1995 Chappell
D364,948 S 12/1995 Hunt
5,478,335 A 12/1995 Colbert
5,507,065 A 4/1996 McBride
5,533,226 A 7/1996 Brown
D372,570 S 8/1996 Dokos
5,593,091 A 1/1997 Harris
5,609,255 A 3/1997 Nichols
5,671,498 A 9/1997 Martin
D388,750 S 1/1998 Williams
D396,908 S 8/1998 Beechuk
D401,703 S 11/1998 Beechuk
5,888,006 A 3/1999 Ping et al.
5,902,757 A 5/1999 Stern
5,960,508 A 10/1999 Holt et al.
5,988,920 A 11/1999 Kunkler et al.
6,003,191 A 12/1999 Sherry et al.
D420,561 S 2/2000 Kunkler
6,045,622 A 4/2000 Holt
6,048,123 A 4/2000 Holt et al.
D425,274 S 5/2000 Kunkler
D427,401 S 6/2000 Kunkler
D428,226 S 7/2000 Kunkler
6,101,661 A 8/2000 Policicchio et al.
6,120,862 A 9/2000 Aouad
6,142,750 A 11/2000 Benecke
6,152,635 A 11/2000 Wu
6,227,744 B1 5/2001 Fodrocy
6,305,046 B1 10/2001 Kingry
6,380,151 B1 4/2002 Masters
D458,427 S 6/2002 Kunkler
D458,722 S 6/2002 Romero
6,405,403 B1 6/2002 McKay
D462,150 S 8/2002 Rader
6,467,983 B2 10/2002 Fodrocy
6,551,001 B2 * 4/2003 Aberegg et al. ..... 401/190
6,579,023 B2 6/2003 Kunkler
6,868,989 B2 * 3/2005 Fahy et al. ..... 222/174
2002/0026680 A1 3/2002 Kingry
2002/0042962 A1 4/2002 Willman
2002/0050016 A1 5/2002 Willman
2002/0065012 A1 5/2002 Takabayashi
2002/0166573 A1 11/2002 Policicchio
2002/0168216 A1 11/2002 Policicchio

* cited by examiner

SURFACE WORKING APPARATUS

BACKGROUND OF THE ILLUSTRATED EMBODIMENTS

1. Related Applications

This application claims priority to PCT Application Ser. No. PCT/US03/20439, for Harris Research, Inc., filed on Jun. 26, 2003, entitled "SURFACE WORKING APPARATUS" which in turn claims priority to U.S. Provisional Patent Application Ser. No. 60/391,720, for inventor Robert D. Harris, filed on Jun. 26, 2002, entitled "FLOOR CLEANING APPARATUS."

2. The Field of the Invention

The present invention generally relates to cleaning implements useful in removing soils and other undesirable items from carpeting, hard flooring or surface. More particularly, the present invention relates to a floor cleaning apparatus having a handle and an absorbent cleaning pad that is removably attached to a cleaning head and disposable after use. An aerosol canister is connected to the apparatus and a trigger is used to selectively dispense the contents of the canister in front of the cleaning head for cleaning the flooring. Various locking means are added to the floor cleaning tool to ensure proper floor chemical application.

3. The Related Background Art

Many products are capable of cleaning hard surfaces such as ceramic tile floors, hardwood floors, and the like. In the context of cleaning floors, numerous devices are described comprising a handle and some means for absorbing a fluid cleaning composition. Most of these devices are reusable, including mops containing cotton strings, cellulose and/or synthetic strips, sponges, and the like. While these mops are generally successful in removing many soils from hard surfaces, they typically require the inconvenience of performing one or more rinsing steps during use to avoid saturation of materials, dirt, soils, etc. These mops therefore require the use of a container to perform rinsing steps to refresh the cleaning implement. Typically, these rinsing steps fail to sufficiently remove dirt residues. This may result in redeposition of significant amounts of soil during subsequent passes of the mop. Furthermore, as reusable mops are used over time, they become increasingly soiled and malodorous. This negatively impacts subsequent cleaning performance.

To alleviate some of the negative attributes associated with reusable mops, attempts have been made to provide mops having disposable cleaning pads. Such cleaning implements are designed to be compatible with hard surface flooring including wood, vinyl, linoleum, no-wax floors, ceramic, glass, and the like. Typically, such cleaning implements include a handle or wand having a floor engaging member which holds a disposable cleaning pad or paper thereto. It has been found that these cleaning pads or paper are not sufficiently absorbent for cleaning large hard surface areas. Thus, a large kitchen or hard floor surface area would require multiple pads in a single cleaning. Also, these cleaning implements typically include a complicated reservoir and electrically driven pump system to deliver cleaning fluid in front of the floor engaging member. Another disadvantage of such cleaning implements is that they are restricted to hard surfaces.

In the past, the cleaning of carpet comprised the steps of vacuuming to remove dust and other non-adhered particles from the carpeting, and either hand scrubbing or using professional cleaning systems to remove stains and other adhered particles and spills. Such professional cleaning systems have typically included complicated fluid delivery systems, fluid suction systems and deposition reservoirs, as well as the need to provide electrical power to such systems and often a continual source of water to dilute and deliver the cleaning solution.

Accordingly, there is a need for a floor cleaning apparatus which is relatively small and lightweight, utilizes disposable pads so as to overcome the disadvantages of reusable cleaning implements, and which is usable on both hard floor surfaces and carpeting. There is also a need for a floor cleaning apparatus which does not require complicated and costly reservoirs, electrically driven pump systems, and the like. The present invention fulfills these needs and provides other related advantages.

Examples of prior patents in the general area of patient management are outlined below. Each of these references is incorporated by reference for its supporting teachings. This application hereby incorporates the following United States patents by reference: U.S. Pat. No. 6,101,661, 6,048,123, 6,003,191, 5,960,508, 5,888,006, and 5,593,091.

Each of these prior art references disclose improvements in the area of patient management. However, none of the foregoing instruction aids have adequately addressed the inherent challenges of floor or surface cleaning or working.

SUMMARY OF THE ILLUSTRATED EMBODIMENT(S)

The various elements of the present invention have been developed in response to the present state of the art, and in particular, in response to the problems and needs in the art that have not yet been fully solved by currently available carpet or floor or surface cleaning or working devices. Accordingly, the present invention provides an improved carpet cleaning device.

In one aspect of the present invention, a cleaning or working implement is provided that is useful in removing soils and other undesirable items from carpeting or hard flooring. More particularly, the present invention relates to a floor cleaning apparatus having a handle and an absorbent cleaning pad that is removably attached to a cleaning head and disposable after use. An aerosol canister is connected to the apparatus and a trigger is used to selectively dispense the contents of the canister in front of the cleaning head for cleaning the flooring. Various locking mechanisms are added to the floor cleaning tool to ensure proper chemical application.

In another aspect of the illustrated embodiment(s), a floor cleaning or surface working apparatus is provided with a main shaft and a handle coupled to the main shaft. A trigger is mounted to the main shaft, and an actuator has a trigger end coupled to the trigger and an actuation end positioned at an opposite end of the main shaft from the handle. Additionally, a canister holder is provided, and is positioned on the main shaft at an opposite end from the handle. The canister holder preferably has a canister locking means mounted thereto, proximate to the actuation end of the actuator. A cleaning head is pivotally coupled to an end of the main shaft in a fashion enabling contact with the floor. Moreover, a canister is releasably mounted to the canister holder and contains a floor working solution. The canister is formed with a canister nozzle top designed with a canister top locking means that in one embodiment conformally fits into the canister locking means of the canister holder.

In yet a further feature of the illustrated embodiment(s), a swivel device is coupled to and between the shaft and cleaning head. The swivel device is preferably designed to enable the cleaning head to pivot and swivel relative to the shaft. A cleaning pad is coupled to a bottom surface and a top surface of the cleaning head. An axle is depicted coupled through the main shaft and swivel device.

A feature of the illustrated embodiments is that the canister may be positioned to project the floor or surface working solution onto an area of a surface that is directly in front of the cleaning head. Additionally, the canister top is preferably positioned so that a substantial portion thereof will be located in front of the cleaning head when the main shaft is elevated in angle while maintaining the cleaning head on the floor.

The illustrated embodiments also may be provided with feature in which the holder comprises a holding cavity, positioned along a length of the holder, designed to retain the canister therein. Additionally, the holder may include a bottom cavity, positioned below the holding cavity, designed to mount over and retain the main shaft, the bottom cavity including: at least one rib, positioned and designed to conformably fit against the main shaft to assist in stabilization of the shaft when fit thereover; and a front end, positioned at one end of the holding and bottom cavities, having: a housing, including a housing top, side, and bottom, designed and shaped to protect the canister nozzle top from accidental activation from bumping into objects; and a canister top mounting bracket and a support shelf, both positioned in the housing top and designed to allow only certain canisters that have a matching design.

The illustrated embodiment(s) additionally may have the holder designed with a releasable catch, positioned opposite the front end, having a retaining lip mounted thereon that is designed to releasably retain the canister upon being affixed within the holding cavity; and a ramp, positioned on the holding cavity opposite the releasable catch, designed to securely hold a canister that has a rounded top portion.

Additionally, a feature of the illustrated embodiment(s) may be to have the canister locking means including a ramp, positioned on the holding cavity opposite the releasable catch, designed to securely hold a canister that has a rounded top portion. The locking means may also include a releasable catch, positioned opposite the front end, having a retaining lip mounted thereon that is designed to releasably retain the canister upon being affixed within the holding cavity. The locking means may also have a canister top mounting bracket and an integral support shelf, both positioned opposite the releasable catch, and designed to allow only certain canisters that have a matching canister top design.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention. These and other features and advantages of the present invention will become more fully apparent from the following description and appended claims, or may be learned by the practice of the invention as set forth hereinafter.

BRIEF DESCRIPTION OF THE DRAWINGS

In order to more easily understand the advantages of the invention, a more particular description of the invention, briefly described above, will be rendered by reference to specific embodiments thereof, which are illustrated in the appended drawings. It is noted that similar element numbers within and between each of the Figures are intended to indicate the same features of the invention. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE ILLUSTRATED EMBODIMENT(S)

As shown in the accompanying drawings for purposes of illustration, the present invention resides in a surface working apparatus. In one embodiment provided by way of example, the surface working apparatus is a floor cleaning apparatus, generally referenced by the reference number 10.

The apparatus 10 is configured such that it can clean either hard flooring, such as linoleum, wood vinyl, ceramic, tile, etc., as well as carpets and rugs. As will be described more fully herein, the apparatus 10 is of relatively simple design and construction and does not include the use of electrical power sources, complicated pumps, liquid reservoir systems, etc. as with precious floor cleaning implements.

Figure 1:
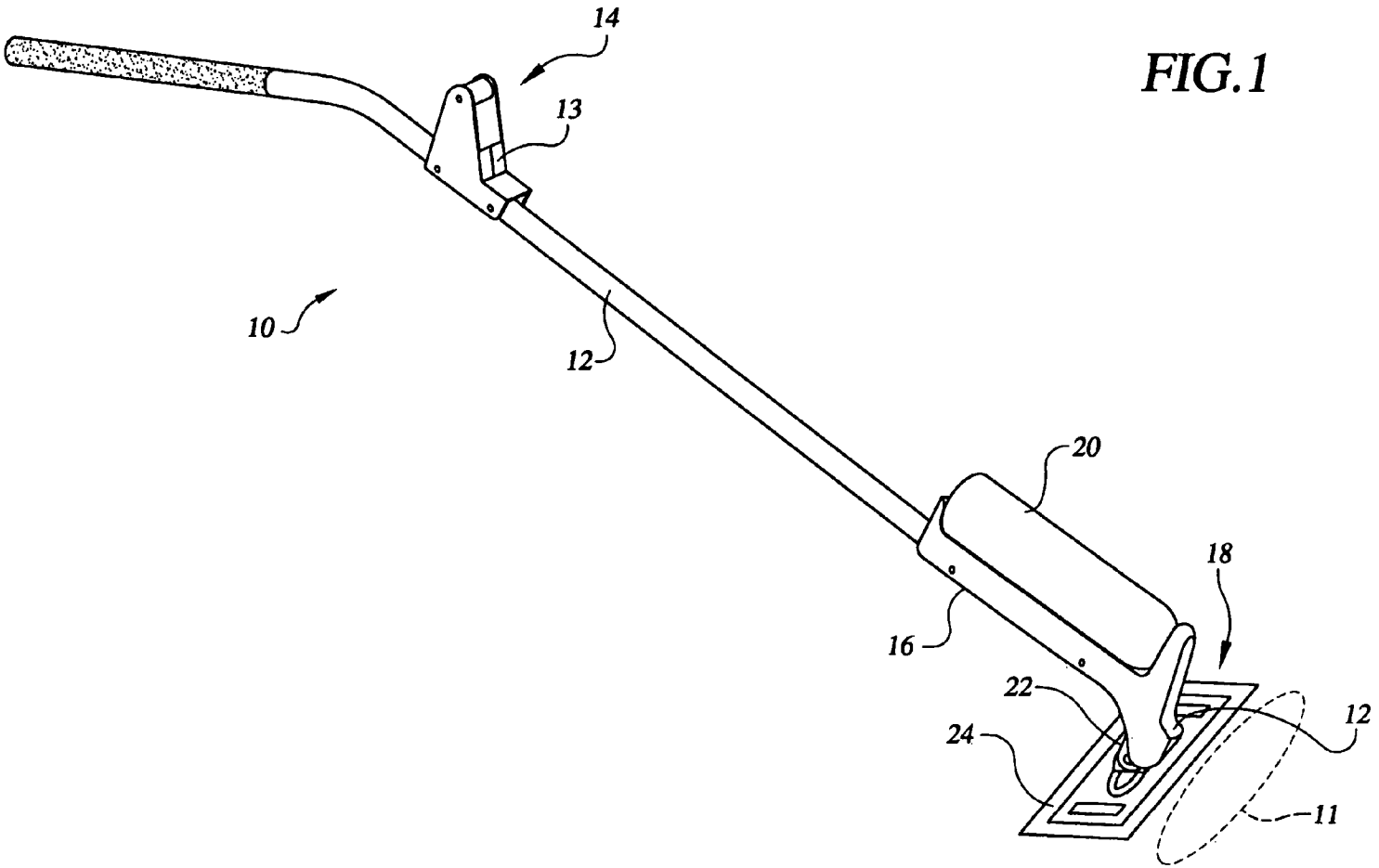
FIG. 1 is an isometric view of one embodiment of a surface working apparatus of the present invention.
Figure 2:
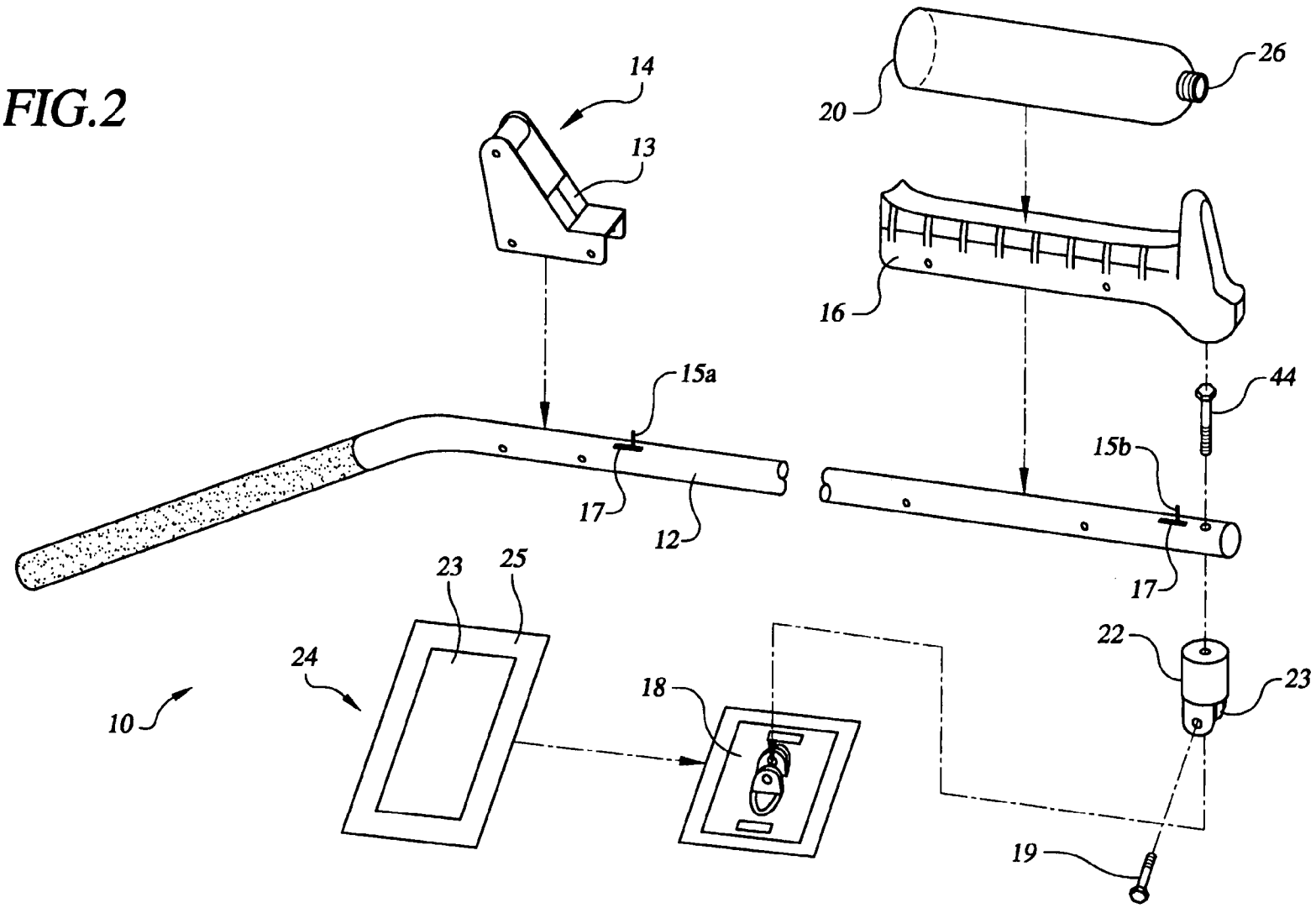
FIG. 2 is an exploded view of the surface working apparatus of FIG. 1.

Referring now to FIGS. 1 and 2, illustrated therein is an overall isometric and an exploded view of portions of the illustrated embodiments. Specifically, illustrated is a carpet cleaning tool 10, having a main shaft 12, trigger 13, handle 14, actuator rod 15, canister holder 16, cleaning head 18, canister 20, axle 19, swivel device 22, swivel supports 23, cleaning pad 24, canister nozzle top 26, and axle 44.

The shaft 12 may be hollow to allow for bolts (not shown) that fit through strategically placed holes to anchor the handle 14 and holder 16. It is noted that the actuator rod 15 may have two opposite ends 15*a* and 15*b* that extend out of slots 17 in shaft 12 and which are illustrated in FIG. 2. The actuator rod 15 also extends through the entire length of the shaft 12 to couple the two exposed ends to form a single unitary piece. Rod end 15*a* is referred to as a trigger end, and rod end 15*b* is referred to as an actuation end. The handle 14 is mounted over the rod trigger 15*a* so that trigger 13 can actuate the rod 15 in a back and forth motion through the slots 17. The back and forth motion of the rod 15 causes the actuation end 15*b* to contact the canister top 26, allowing cleaning liquid, which is stored in canister 20 under pressure, to be projected onto an area of a surface 11 that is directly in front of the cleaning head 18, as is generally indicated by the dashed lines in FIG. 1.

One skilled in the art will readily understand that as the shaft 12 is elevated toward a vertical position while maintaining the cleaning head 18 flat on a carpet the holder 16 and the canister top 26 are generally intended to be positioned so that a substantial portion thereof will be pointed or located in front of the cleaning head 18. A purpose for that orientation of the canister top 26 is to ensure that upon actuation of the canister 20 the cleaning contents are projected in front of the cleaning head.

Under one embodiment of the present invention, the canister 20 is formed with a concave bottom, as indicated with the dashed lines in FIG. 2.

It is noted that the axle 44 pivotally anchors through the shaft 12 and through the swivel device 22, and is preferably not coupled to the holder 16. Additionally, the cleaning pad 24 preferably includes an absorbent portion 23 positioned on a bottom side of cleaning head 18 and a top attachment portion 25 that wraps on top of the cleaning head 18.

In certain embodiments, the cleaning solution within the canister 20 may be selected to be a solvent, stain remover, concentrate surfactant, etc. Thus, a canister of solution may be selected to fit the task at hand, whether it is a simple cleaning or stain removal. Specialized carpet solution or hard floor surface solutions may also be selected by merely removing the prior canister 20 and inserting the appropriate new canister 20 into the holder 16.

The main shaft 12 may include a track to enable the trigger 13. The coupled rod assembly 15 is configured to be pulled toward the user upon actuation of the trigger, simultaneously causing the actuation rod end 15*b*, positioned adjacent to the canister top 26, to apply pressure to the top 26. This, in turn, causes the cleaning solution to be emitted from the canister 20. The trigger 13 and rod assembly 15, 15*a* and 15*b* may include spring-biasing means, causing the trigger 13 to return to an "off" position automatically upon release.

Figure 3:
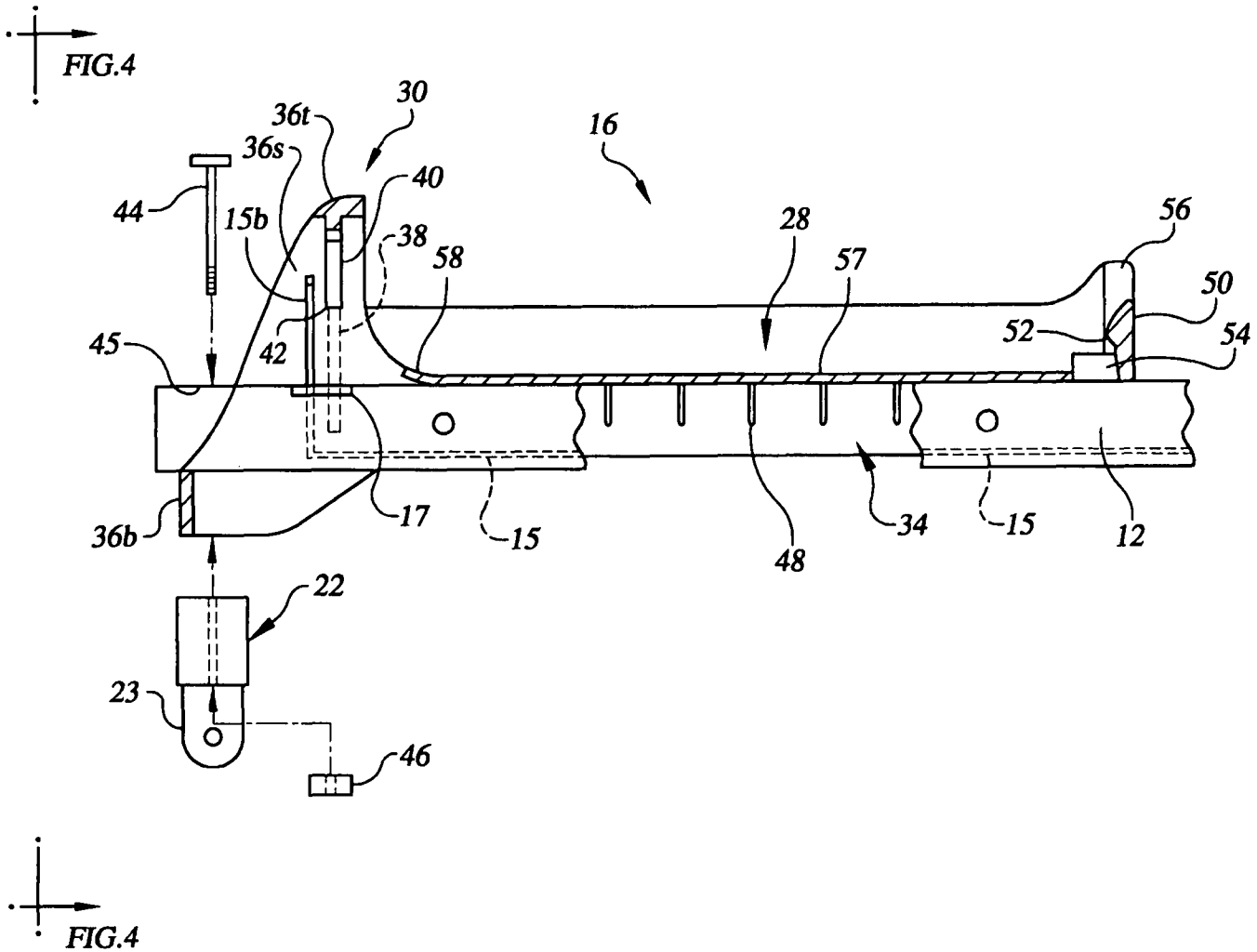
FIG. 3 is a cross sectional view of one embodiment of a canister holder and actuator of the present invention.
Figure 4:
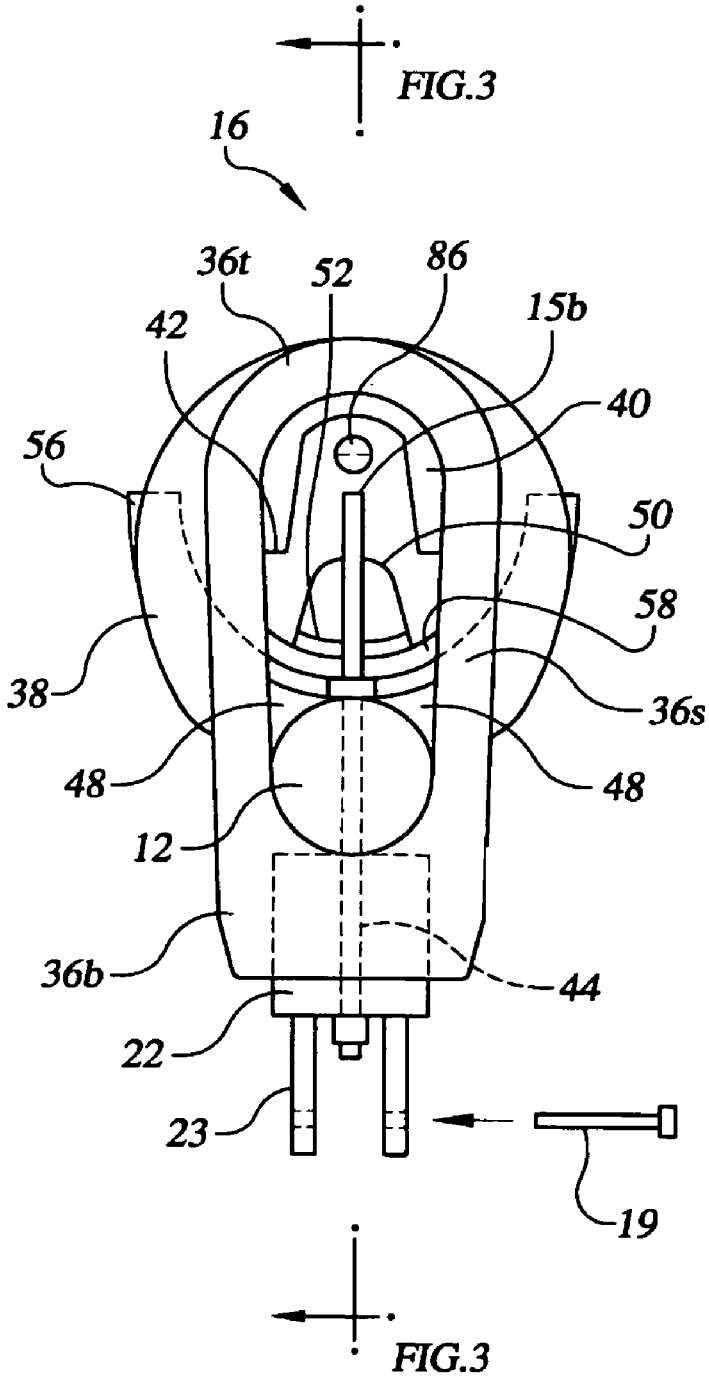
FIG. 4 is a front view of the canister holder and actuator of FIG. 3.

FIGS. 3 and 4 are respectively a cross sectional side view and a straight on view of the holder 16. Shown therein are a holding cavity 28, a front end 30, a back end 32, and a bottom cavity 34 that mounts over the shaft 12. Disposed at the front end 30 is a front housing 36 that has a housing top 36*t*, a housing side 36*s*, and a housing bottom 36*b*. A housing front panel 38 is also shown and may be used for mounting the housing and for retaining the canister 20 therein. A canister top mounting bracket 40 is shown with edges that form a support shelf 42. Ribs 48 are positioned in the bottom cavity to conformably fit against shaft 12 to assist in stabilization when assembled.

It is noted that a skilled artisan will understand the advantage of having the actuation rod end 15*b* extending sufficiently high from the shaft 12 to properly contact the canister top 26 for activating release of the cleaning contents stored in the canister 20.

Referring now to the back end 32 and the cavity 28 of the holder 16, shown is a releasable catch 50 having a lip 52. There is also a space 54, side portions 56, bottom portion 57, and ramp 58. In the operation of mounting the canister 20 into the cavity 28, the canister top 26 is first positioned into the front end 30 of the holder and the back end of the canister 20 is then forced down against the releasable catch 50, causing the catch 50 to flex sufficiently to allow the canister's outer edge of the concave bottom portion to fit past the lip 52. Thereby, the lip 52 holds the edge of the canister bottom in an expected fashion. Similarly, the ramp 58 is designed to match the curvature of a portion of the canister that is near the canister top 26.

In one embodiment, the side portions 56 are coupled to the catch 50 with a minimum amount of restraint on the flexibility of the catch 50 as illustrated best in FIG. 4. Also, the space 54 serves the same purpose by eliminating any contact with the bottom portion 57. A skilled artisan will also appreciate that the entire cavity 28 may have a concave surface to match the canister 20.

One skilled in the art will notice that many of the elements associated with the holder 16 are designed to ensure that a user will only be able to employ a certain dimensioned canister 20 into the proper position to spray cleaning contents onto a floor. In other words, these specific features form a locking mechanism that prevents unauthorized canisters from being inserted into the cavity 28. It may also assure that the canister 20 is inserted only in a selected direction. In one embodiment the locking mechanism includes, but is not limited to, a ramp 58, a catch 50, a lip 52, and a concave cavity 28. The locking mechanism may also be formed or determined by the overall length of the holder, the selected height and shape of the canister top mounting bracket 40, the dimensions of the support shelf 42, and the height and positioning of the rod actuation end 15*b*.

The axle 44 in the depicted embodiment extends through a hole 45 and through the swivel device 22 to be fastened to a nut 46. The swivel device 22 of the depicted embodiments preferably fits within the housing bottom 36*b* and up against the shaft 12 to allow for rotation of the swivel device 22 around the axle 44 in a known fashion. The housing bottom 36*b* is designed to. conformally fit around the device 22 on three sides.

It is also be pointed out that the axle 44 is preferably positioned at a farthest end of the shaft 15 to allow for the front end 30 of the holder 16 to be in a position that is in front of the location of the cleaning head 18. This allows the canister top 26 to be positioned close to the floor. This closeness allows the optionally pressurized cleaning contents to be applied in front of the cleaning head during cleaning operations as illustrated in FIG. 1.

The housing top 36*t* and housing sides 36*s* are preferably designed to protect the canister top 26 while mounted to the holder 16. This is helpful when operating the floor cleaning device 10, when the top 26 is located near the floor where it may come into contact with other items on the floor like furniture that may cause accidental activation of the top 26 and result in undesired spraying of the cleaning contents. Thus, the housing 36 is preferably designed to engulf the top 26 for protection.

In one embodiment, the bottom housing portion 36*b* acts as a support and a protection piece for the swivel device 22. The support and protection is needed since use of the cleaning head 18 often employs large forces in a downward direction along the shaft 12. Specifically, the shaft 12 is intended to rest against a top edge of the bottom housing 36*t* as illustrated. This design allows for some of the pressure to be exerted onto the housing instead of exclusively along the axle 44, which would have the effect of damaging the axle hole 45 over time. Thus, the lower housing design 36*b* adds structural integrity to the overall design.

Figure 5:
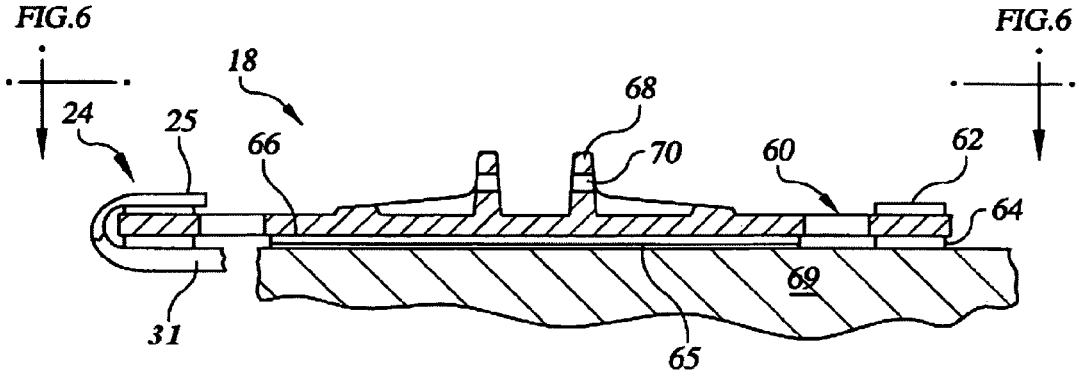
FIG. 5 is a cross sectional side view of one embodiment of a cleaning head of the present invention.
Figure 6:
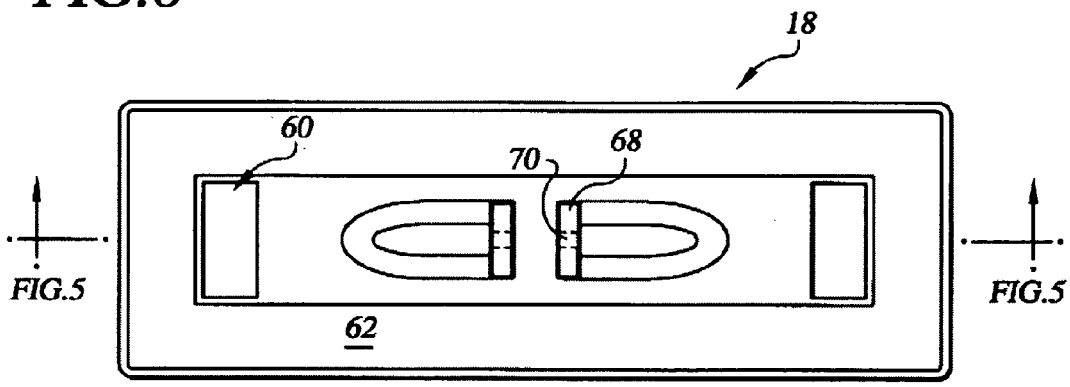
FIG. 6 is a top view of the cleaning head illustrated in FIG. 5.
Figure 7:
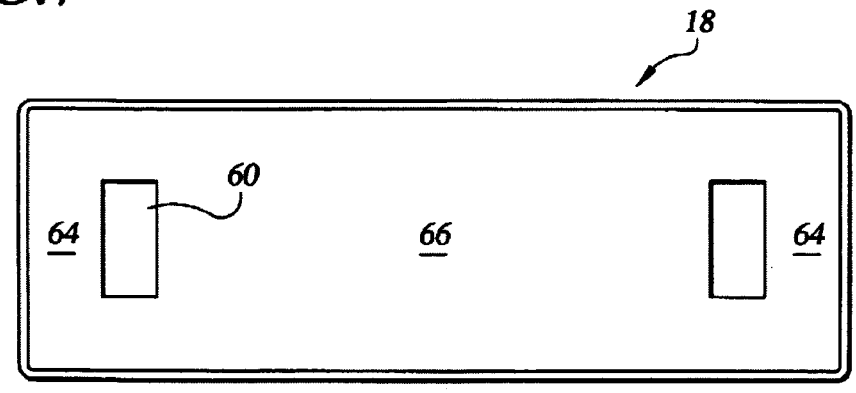
FIG. 7 is a bottom view of the cleaning head illustrated in FIG. 6.

Referring now to FIGS. 5, 6 and 7, shown therein are a side cross sectional view, a top view, and a bottom view of the cleaning head 18. The floor 69 is cut away on the left side of FIG. 5 to allow for a segmented and exaggerated view of the manner in which the cleaning pad 24 is mounted to the cleaning head 18. Specifically, a dirt viewing window 60 is preferably provided. An attachment mechanism may also be provided and in one embodiment is in the form of a hook and loop design 62, 64 and 66. Also illustrated is a centrally located cavity 65 that is formed between the floor 69 and a central arched bottom surface of the cleaning head 18 as best illustrated in FIG. 5. Additionally, two projections 68 are provided with holes 70 formed as illustrated to accommodate axle 19 and supports 23 to be mounted in a known fashion to pivotally couple the swivel device 22 to the cleaning head 18.

One aspect of the present invention is the composition of the cleaning pad 24. It has been found that baby diapers work very well as a cleaning pad. The cloth backing of the diaper material sticks to a standard hook and loop tape, and the diaper itself has characteristics that provide surprising results. The pad 24 of the present invention is intended to work best when comprised of materials similar to a baby diaper. Consequently, in one embodiment the pad includes a hydrophobic layer, section 23 that engages the flooring. Within that layer 23 is an absorbent pad material including particles such as gel granules that wick the water away from the floor. Dirt and debris are not, in this embodiment, picked up. Rather, fluid that has dirt suspended therein is absorbed through the hydrophobic layer, and the exterior of the pad does not retain the dirt and residue to the extent of prior art disposable pads. Also, due to the characteristics of the absorbent material within the pad 24, a single pad is able to be used on a floor of much greater surface area than prior art pads. The pad itself, due to existing technology, costs much less to produce. An added benefit is that the pad 24 of the present invention has sufficient durability that it can be used on carpets and rugs.

In partial operation of the floor cleaning tool 10, the cleaning head 18 is logically covered with the cleaning pad 24 so that the edges 25 are removably coupled to the attachment mechanism 62 and may be attached along the entire periphery of the head 18. Similarly, the cleaning pad section 23 is optionally designed to have extra padding in a known fashion, to provide for extra absorbency of the cleaning liquid contained in the canister 20. Once cleaning operations have been initiated, dirt is collected and absorbed into cleaning pad 24 and absorbed into the padded section 23. As the cleaning continues, a user will be able to observe the relative amount of dirt that has been collected by viewing the cleaning pad color change through the window 60. This arrangement has the advantage of not requiring the user to look at the bottom of the cleaning pad to determine the relative amount of dirt collected on the cleaning pad 24. Once the cleaning pad is sufficiently dirty, a user may replace the pad 24 in a known removal and replacement fashion.

In one embodiment, prior art cloth pads are mounted to the cleaning head 18 in a less then rigorous manner. The reason for flexible attachment is that most floor cleaning implements of similar design are only intended to be operated on smooth floors, such as wood or tile. The present embodiments contemplate use on carpets, which are far from smooth and exert a much larger degree of friction on the cleaning pad. The greater friction causes prior art cleaning implements to loose their weakly attached cleaning pads in a matter of moments. Thus, the current illustrated embodiments utilize an attachment mechanism 62, 64 and 66 that can be rigorously attached to the cleaning pad 24. Specifically, for example, a hook and loop type attachment may be employed not only on the top surface bordering the periphery of the cleaning head, but also substantially covering the complete underside thereof. Thus, during scrubbing operations, the cleaning pad 24 stays in place and moves with the motion of the cleaning head instead of being forced off from its position on the cleaning head as with prior art designs.

A troublesome phenomenon exists in the cleaning head design. Specifically, during cleaning operations, the leading edge of the cleaning head 18 is often the edge that collects the most amount of dirt, while the trailing edge collects less dirt. This collection of dirt is observable through the windows 60 by the user. Knowledge of when dirt has collected allows the user to know when to rotate the cleaning head 180 degrees to enable the former trailing edge to now become the leading edge. Thus, knowing how the phenomenon operates through the use of the window 60, a user is provided with the advantage of extending the cleaning life of the cleaning pad, and is provided with extended time for optimal cleaning operations through the use of a more clean section of the cleaning pad 24 engaged in the optimal dirt collection position.

In one embodiment, the cavity 65 is located and positioned as illustrated, extending laterally from one side to the other of the cleaning head 18 as illustrated in FIG. 5. The bottom surface of the cleaning head is shaped so that the concave bottom surface is concave in a first direction across the bottom surface and substantially flat in a second direction across the bottom surface, the first direction being perpendicular to the second direction. This arrangement increases the application force of the cleaning head 18 along the entire length of the head. Specifically, when a user applies force onto shaft 12, the force is concentrated directly in the middle of the cleaning head 18 in the region of supports 68. The force causes the collapse of the cavity 65 and allows for a more even distribution of the force to the entire bottom surface of the cleaning head 18. Thus, the cavity has the effect of increasing the useful cleaning surface of the cleaning head over prolonged usage of the cleaning head. Whereas, in the prior art, a flat cleaning head is used, which applies a concentrated force in the central region and much less force to the outer regions. This uneven application of force has been known to cause the phenomenon of edge curling. Edge curling occurs after prolonged application of force to this cleaning head design, and actually causes the outer edges (left and right on FIG. 5) to permanently be curled upward, thus eliminating all even force application. Edge curling is substantially reduced or even eliminated by the present invention, and a more even application of force can be achieved over a longer period of time.

Figure 5A:
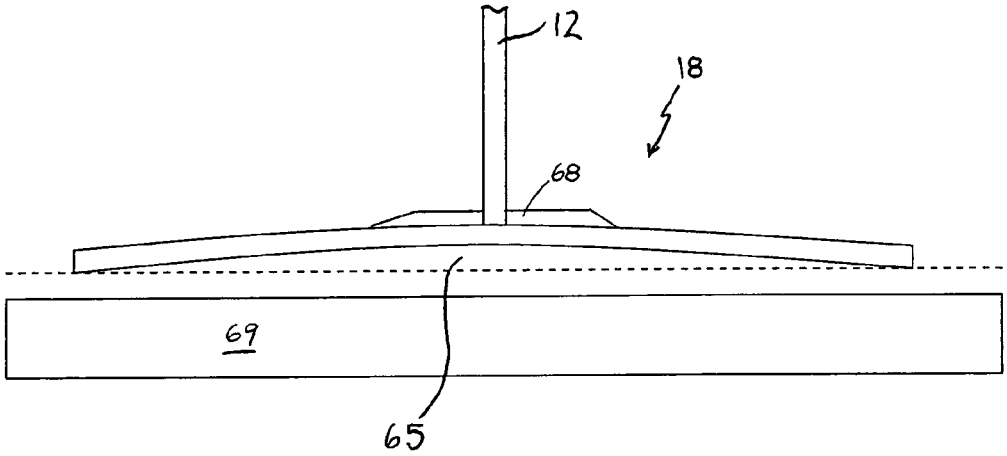
Figure 5B:
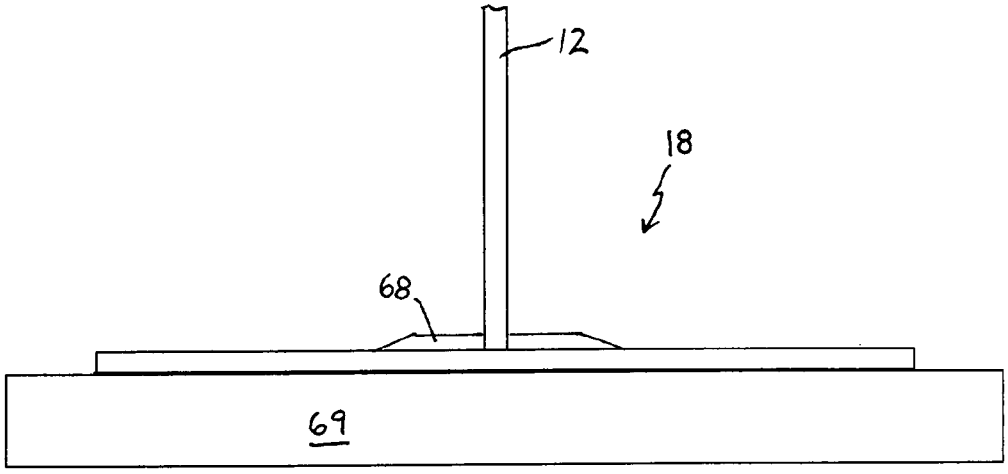

FIG. 5*a* illustrates one embodiment of the invention, wherein the cavity 65 is extending laterally from one side of the cleaning head 18 to the other. This arrangement increases the application force of the cleaning head 18 along the entire length of the cleaning head 18. Specifically, when a user applies force onto the shaft 12, the force is concentrated directly in the middle of the cleaning head 18 in the region of the supports 68. The force causes the collapse of the cavity 65, as illustrated in FIG. 5*b*, and allows for a more even distribution of force to the entire bottom surface of the cleaning head 18. Thus, the cavity 65 has the effect of increasing the useful cleaning surface area of the cleaning head 18 over prolonged usage of the cleaning head 18. Whereas, in the prior art, a flat cleaning head is used, which applies a concentrated force in the central region and much less force to the outer regions. This uneven application of force has been known to cause the phenomenon of edge curling. Edge curling occurs after prolonged application of force to this cleaning head design, and actually causes the outer edges to permanently be curled upward, thus eliminating all even force application. Edge curling is substantially reduced or even eliminated by the illustrations 5*a* and 5*b*, and a more even application of force as illustrated may be achieved over a longer period of time.

Figure 8:
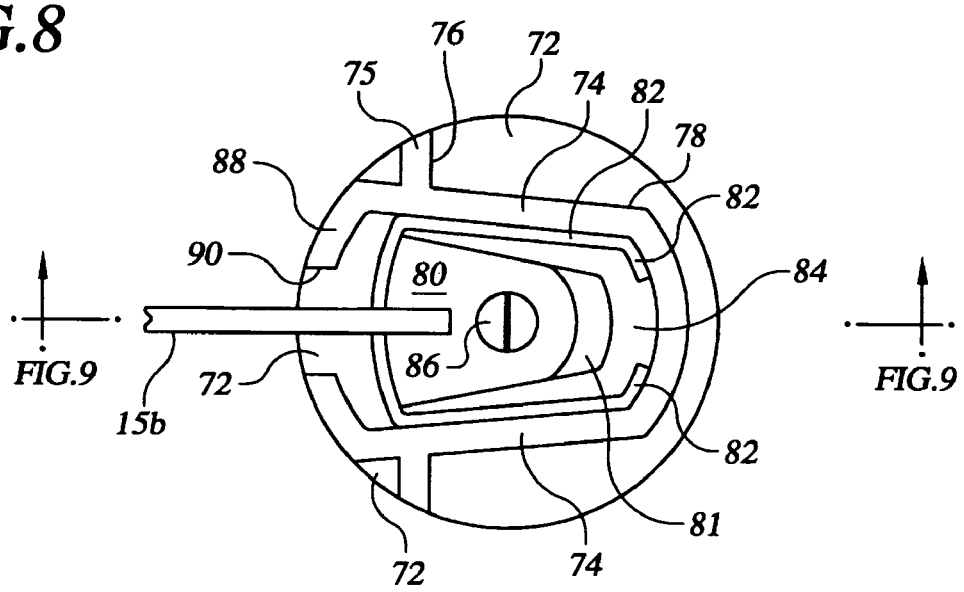
FIG. 8 is a top view of one embodiment of a canister top of the present invention.
Figure 9:
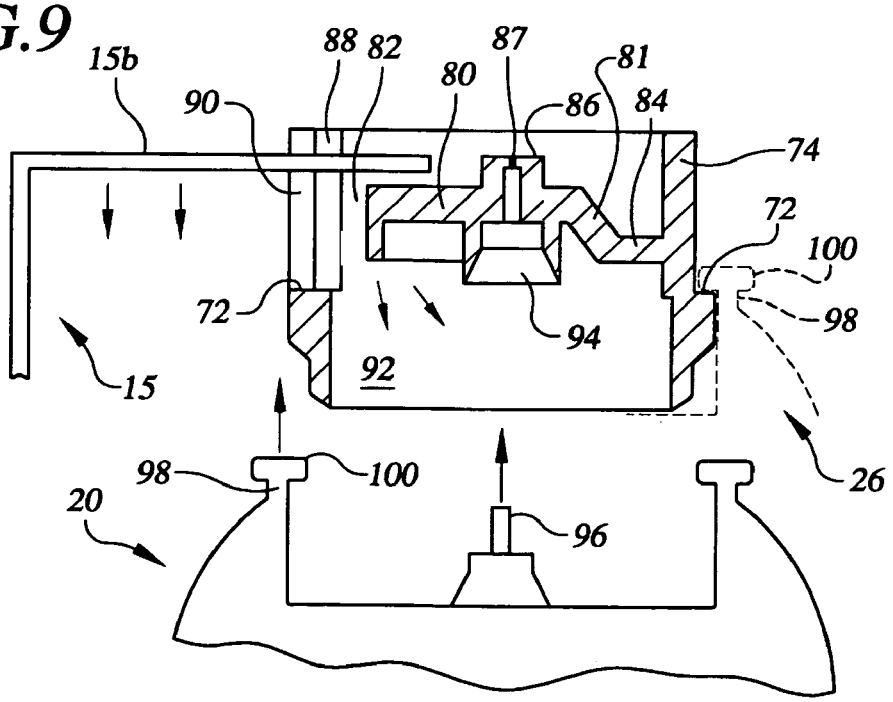
FIG. 9 is a cross sectional side view of the canister top of FIG. 8.

FIGS. 8 and 9 are a top view and cross sectional view of the canister top 26. Illustrated therein are a base section 72, a keyed wall 74 with a keyed wall outer surface 78, a keyed tab 75 having a keyed tab surface 76, a canister spout actuation platform 80 coupled to base section 72 via hinge section 84 and ramped section 81, a platform space 82, a nozzle 86, a spray port 87, a rod guide wall 88 with a guide wall surface 90, main cavity 92, spout cavity 94, spout 96, canister top wall 98, and wall lip 100.

In operation, a rod actuator end 15*b* traverses its location in the direction indicated to actuate the nozzle platform 80. This causes sufficient bending of the canister spout 96, which in turn causes the spout to eject pressurized cleaning fluid from the canister 20. Preferably, the canister spout is located in the canister spout cavity 94, positioning the spout opening proximate to the nozzle opening 87.

Also during operation, the platform 80 is deflected downward and pivots about the hinge 84. Additionally, the rod guide wall 88 may have a height sufficient to maintain the actuation rod end 15*b* from moving too far to the right or left (as viewed on FIG. 8). So doing would cause the rod 15*b* to fall off of the platform 80 and prevent actuation of the canister spray cap 26.

The keyed wall 74 and the keyed tab 75 are, in one embodiment, designed to fit securely into the canister top mounting bracket 40 with a support shelf 42, as illustrated in FIGS. 3 and 4. Specifically, the bracket 40 and the keyed wall surface 78 have matching configurations, illustrated as a slight inward tapering in at the top and a tapering out at the bottom (near the shelf 42). Additionally, there is preferably a complete match between the support shelf 42 and the keyed tab surface 76. Thus, when the canister 20 is inserted into the cavity 28, the matching portions preferably come into conformal contact. The conformal contact ensures that the nozzle opening 87 is properly oriented. In the depicted embodiment, the selected orientation is parallel to the tab surface, which in turn is parallel to the leading edge of the cleaning head when it is perpendicular to the line of motion when pushing the shaft in a straight-on fashion (generally illustrated in FIG. 1).

The canister top wall 98 is in one embodiment designed to fit over and up to base 72 so that lip 100 securely and releasably fits thereover, to secure the canister top 26 to the canister 20 as illustrated in dashed lines on the right side of FIG. 9.

In one manner of the operation of the floor cleaning tool 10, the user first selects the appropriate solution for the task at hand and inserts the appropriate canister 20 containing a surface working solution into the holder 16, as described above. The disposable pad 24 is attached to the cleaning head 18 as described above. The user then grasps the main shaft and handle 14 in a commonly know manner to begin scrubbing the selected floor site. Periodically, the trigger 13 is actuated to release the cleaning solution from the pressurized canister 20 so that solution is projected in front of the cleaning head 18. The user then continues to forcibly move the cleaning pad 24 over the surface, either hard flooring or carpeting, to be cleaned. As will be appreciated by the skilled artisan, it may only require a very small amount of solution to clean hard floor surfaces, as the cleaning pad 24 is generally able to be moved in long sweeps while adequately cleaning the floor. However, to remove stains from a carpet or the like, more solution may be required and short and forceful movement of the pad 24 over the stained area may be required to remove the stain. Upon completion, the pad 24 may be removed and disposed of if sufficiently dirty. The floor cleaning apparatus 10 may be stored much like a broom or traditional mop.

Variations of the Illustrated Embodiment(s)

It is noted that in a skilled artisan would understand that there are many potential variations available to many of the features of the illustrated embodiments that will be clear after becoming familiar with the above description. For example, any surface cleaning device with a shaft 12 may incorporate the features of the holder 16 and locking canister 20 designs. Additionally, any type of pressurized canister may be used to take advantage of the teachings regarding the canister top 26. Moreover, the disclosure may teach the use of the apparatus 10 for floor cleaning, but a skilled artisan will realize that any hard surface may be cleaned by the apparatus and is so intended. Thus, any reference to the word "floor" should also include the meaning of a surface, whether or not it is a floor for walking on. Also, the apparatus 10 may be used for purposes other than cleaning, like applying paint or other liquids to a surface.

Although the above embodiment illustrates a certain design of the handle 14, the present invention may be used with any known type of handle that has the ability to actuate a trigger 13. Additionally, the location of the handle 14 is intended to be variably adaptable to various users.

Additionally, the canister 20 has been illustrated to be a certain design, where in fact it is contemplated to employ most any type of canister design. These design variations include, but are not limited to, the use of pressurized and non-pressurized canisters, canisters with rounded surfaces, square surfaces, smooth surfaces, and surfaces with variable ridges along the sides of variable dimensions and depth. This same design variation also applies to the particular appearance of the holder 16, which is considered to be completely variable in design and appearance. Additionally, the holder 16 may be integrally formed with the shaft 12. Furthermore, the cleaning head may be illustrated as a squared-type design; however, it is equally contemplated to have most any practical shape used thereby.

Referring back, FIGS. 3 and 4 illustrate only one type of design for each of the elements; however, many variations are applicable as may be applied by one skilled in the art of canister holder designs. For example, although only one tab 50 is illustrated, several tabs may be employed and may be of most any shape sufficient to retain a bottom side of a canister when placed thereagainst. The front section 30 illustrates a certain design, yet there are many variations that will maintain the holding of the canister therein and will protect the canister top 26 and the swivel device 22.

Additionally, although a certain canister top mounting bracket 40 with a support shelf 42 is illustrated, many different designs are contemplated. Specifically, bracket shapes may include square or rounded bracket shapes, and any other shape imaginable that may be formed with a corresponding design on the canister top 26.

Even though the lower cavity 34 is illustrated to be of a certain design, it has also been considered to employ most any type of cavity capable of housing the shaft 12 therethrough. Specifically, a completely closed cavity may be employed, or a completely non-enclosed design, or any design therebetween.

Referring now to FIGS. 5-7, certain of the features are considered to have several variations contemplated to be covered by the present disclosure. For instance, the space 65 is illustrated to be-a certain relative size, however most any size will suffice, so long as the expected pressure to be applied by a user is sufficient to create a relatively even application of pressure along the entire bottom surface of the cleaning head 18. Of course, any material that is flexible enough to accommodate the requisite flexure of the cleaning head 18 may be used.

Additionally, the viewing ports or holes 60 are not required to be located in any particular position or to have any particular shape. The main function of the holes 60, of exhibiting the relative dirt collected at the leading edge and trailing edge, can be accomplished using any number of ports 60, not just two as illustrated. The ports 60 may also be of any shape or size.

Regarding FIGS. 8 and 9, there are also many specifically contemplated variations to the features contained therein. The specific design of the keyed wall and keyed wall outer surface, just as the matching canister top mounting bracket 40 with a support shelf 42, have the same matching variations contemplated. Also, a certain design of the canister upper portion, wall 98 and lip 100, is illustrated in FIG. 9, but any shape may be used as long as some mechanism for locking or coupling the canister top 26 thereto in a secure releasable fashion is provided.

The present invention increases the ease of spot cleaning carpets over the currently available art. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A surface working apparatus, comprising:

a main shaft;

a handle coupled to the main shaft, and having a trigger mounted thereto;

a cleaning head coupled via a coupling device to one end of the main shaft in a fashion enabling contact with a surface to be cleaned, the cleaning head comprising a leading edge and a trailing edge;

a canister holder attached to the main shaft, and configured to hold a canister containing a cleaning solution, wherein a nozzle end of the canister is exposed through a front end of the canister holder; and an actuator functionally coupled on one end of the trigger, and positioned at a front end of the canister holder on an opposite end, such that movement of the trigger is configured to functionally engage the actuator thus liberating the cleaning solution from the canister;

wherein the cleaning head includes a smooth concave bottom surface sufficiently long to create a gap between the cleaning head and the surface to be cleaned;

wherein the smooth concave bottom surface is flexible such that the gap is collapsed when a force is applied to the main shaft;

wherein the concave bottom surface is concave in a first direction across the bottom surface and substantially flat in a second direction across the bottom surface, the first direction being perpendicular to the second direction;

wherein in a surface cleaning position the main shaft extends upwardly behind and away from the coupling device at an angle with respect to a surface to be cleaned, the trailing edge is positioned beneath at least one of the main shaft and canister holder, and the leading edge is positioned in front of the coupling device such that the coupling device is positioned between the leading edge and trailing edge; and wherein in the surface cleaning position, the canister holder is configured to position a substantial portion of the nozzle end of the canister in front of the leading edge of the cleaning head.

2. The apparatus of claim 1, wherein the coupling device comprises a swivel device configured to couple the main shaft to the cleaning head, the apparatus further comprising a cleaning pad removably attached to the bottom surface of the cleaning head.

3. The apparatus of claim 1, wherein the main canister holder attaches to a top portion of the main shaft.

4. The apparatus of claim 1, further comprising a canister positioned in the canister holder and configured to release the cleaning solution onto an area directly in front of the cleaning head.

5. The apparatus of claim 1, wherein the canister holder comprises a holding cavity, positioned along a length of the canister holder and configured to retain the canister therein.

6. The apparatus of claim 5, wherein the canister holder further comprises a bottom cavity positioned below the holding cavity, designed to receive and couple to the main shaft.

7. The apparatus of claim 6, wherein the canister holder further comprises a front end housing configured to protect a nozzle of the canister from accidental activation.

8. The apparatus of claim 7, wherein the front end housing further comprises a canister top mounting bracket and a support shelf designed to allow only certain canisters that have a matching canister top design.

9. The apparatus of claim 8, wherein the canister holder further comprises: a releasable catch, positioned opposite the front end housing, having a retaining lip mounted thereon that is designed to releasably retain the canister upon being affixed within the holding cavity; and a ramp, positioned on the holding cavity opposite the releasable catch, designed to securely hold a canister that has a rounded top portion.

10. The apparatus of claim 1, further comprising a canister locking means, wherein the canister locking means comprises: a ramp, positioned on the holding cavity opposite the releasable catch, designed to securely hold a canister that has a rounded top portion; and a releasable catch, positioned opposite the front end housing, having a retaining lip mounted thereon that is designed to releasably retain the canister upon being affixed within the holding cavity, and a canister top mounting bracket and support shelf, both positioned opposite the releasable catch, and designed to allow only certain canisters that have a matching canister top design.

11. The apparatus of claim 1, wherein the canister holder further comprises a housing configured to protect the canister nozzle top from accidental actuation while mounted to the canister holder.

12. The apparatus of claim 1, further comprising: a cleaning pad, removably mounted to the cleaning head, designed to collect quantities of surface liquid and discoloring over time of use; and a window, positioned on the cleaning head to allow a user to view relative amounts of discoloration of the cleaning pad during operation of the cleaning apparatus.

13. The apparatus of claim 12, wherein the cleaning head further comprises an attachment means, positioned on a bottom side of the cleaning head except where there is a window, and is positioned on a periphery of a top surface of the cleaning head, so that the cleaning pad may be coupled to the bottom side of the cleaning head and the top periphery of the cleaning head.

14. The apparatus of claim 13, wherein the attachment means is a hook-and-loop design.

15. The apparatus of claim 1, further comprising a canister nozzle top configured to attach to the canister; wherein:

the canister nozzle top further includes a keyed nozzle portion that has a particular shape; and the canister holder further comprises a keyed holder portion that is a complement to the keyed nozzle portion, and is configured to ensure that only a canister with the keyed nozzle portion that complements the keyed holder portion is placed within the canister holder.

16. The apparatus of claim 15, wherein the canister nozzle top further comprises: a base section; a keyed wall section with a particular shape, both positioned on the base section;

and a keyed tab positioned on the base section and adjacent the keyed wall section, and positioned to form an angle with the keyed wall section.

17. The apparatus of claim 16, wherein the canister holder further includes: a canister top mounting bracket, positioned so that the keyed wall outer surface juxtaposes the canister top mounting bracket when the canister is positioned within the canister holder; and a support shelf, coupled to the canister top mounting bracket, and positioned so that the keyed tab juxtaposes the support shelf when the canister is positioned within the canister holder.

18. A method of working a surface, comprising:

providing a surface working tool;

selecting a canister containing a cleaning solution;

inserting the canister containing the cleaning solution into a canister holder mounted to the surface working tool;

attaching a disposable pad to a cleaning head of the surface working tool, the cleaning head comprising a leading edge and a trailing edge;

grasping a main shaft and handle of the surface cleaning tool and begin cleaning the surface, the main shaft being coupled to the cleaning head via a coupling device;

applying sufficient pressure to the cleaning head to cause a concave cavity located under the cleaning head to become sufficiently flat relative the surface, wherein the concave cavity is defined by a bottom surface that is concave in a first direction across the bottom surface and substantially flat in a second direction across the bottom surface, the first direction being perpendicular to the second direction; and positioning the main shaft into a surface cleaning position, wherein in the surface cleaning position the main shaft extends upwardly behind and away from the coupling device at an angle with respect to the surface to be cleaned, the trailing edge is positioned beneath at least one of the main shaft and canister holder, the leading edge is positioned in front of the coupling device such that the coupling device is positioned between the leading edge and trailing edge, and the canister holder is configured to position a substantial portion of the nozzle end of the canister in front of the leading edge of the cleaning head;

while in the surface cleaning position, periodically actuating a trigger on the handle to release the appropriate solution from the appropriate canister so that appropriate solution is projected in front of the leading edge of the cleaning head mounted to the surface working tool.

19. The method of claim 18, further comprising:

observing a window positioned on the cleaning head to determine the amount of discoloration of the cleaning pad mounted to the cleaning head;

rotating the cleaning head 180 degrees relative to a first cleaning position upon observing that sufficient discoloration has occurred; and continue cleaning the surface with the rotated cleaning head so that the leading edge acts as a trailing edge and the trailing edge acts as a leading edge.

20. A surface working apparatus, comprising:

a main shaft;

a handle coupled to the main shaft, and having a trigger mounted thereto;

a cleaning head pivotally coupled via a swivel device to one end of the main shaft in a fashion enabling contact with a surface to be cleaned, the cleaning head comprising a leading edge and a trailing edge;

a canister holder attached to the main shaft, and configured to hold a canister containing a cleaning solution, wherein a nozzle end of the canister is exposed through a front end of the canister holder; and an actuator functionally coupled on one end of the trigger, and positioned at a front end of the canister holder on an opposite end, such that movement of the trigger is configured to functionally engage the actuator thus liberating the cleaning solution from the canister;

wherein the swivel device enables the cleaning head to pivot in a vertical direction and a horizontal direction relative to the shaft;

wherein in a surface cleaning position the main shaft extends upwardly behind and away from the swivel device at an angle with respect to a surface to be cleaned, the trailing edge is positioned beneath at least one of the main shaft and canister holder, and the leading edge is positioned in front of the swivel device such that the swivel device is positioned between the leading edge and trailing edge; and wherein in the surface cleaning position, the canister holder is configured to position a substantial portion of the nozzle end of the canister in front of the leading edge of the cleaning head.

* * * * *